United States Patent [19]

Schulle

[11] Patent Number: 4,944,105

[45] Date of Patent: Jul. 31, 1990

[54] ADJUSTABLE BASE FOR NEEDLEWORK FRAME

[76] Inventor: Gaylon E. Schulle, 52 Sundown Pkwy., Austin, Tex. 78746

[21] Appl. No.: 354,132

[22] Filed: May 19, 1989

[51] Int. Cl.[5] ..... D06C 3/08

[52] U.S. Cl. ..... 38/102; 38/102.2; 38/102.4; 38/102.5; 38/102.6; 38/102.7; 38/102.8

[58] Field of Search ..... 38/102–102.91; 223/120

[56] References Cited

U.S. PATENT DOCUMENTS

| | | | |
|---|---|---|---|
| 257,942 | 5/1882 | Hickman | 38/102.4 |
| 544,049 | 8/1895 | Niemand | 38/102.7 |
| 1,074,430 | 9/1913 | Hill . | |
| 1,616,563 | 2/1927 | Allen | 38/102.6 |
| 1,680,610 | 8/1928 | Harmon | 38/102.6 |
| 2,449,492 | 9/1948 | Long | 45/80 |
| 2,555,896 | 6/1947 | Morse | 45/24 |
| 2,691,239 | 10/1954 | McCollum | 45/80 |
| 3,098,280 | 7/1963 | Harris et al. | 28/15 |
| 3,774,326 | 11/1973 | Selden | 38/102.4 |
| 3,869,817 | 3/1975 | Bowman | 38/102.4 |
| 3,938,267 | 2/1976 | Bard | 38/102.1 |
| 3,955,722 | 5/1976 | Bard | 223/120 X |
| 4,292,748 | 10/1981 | Miller | 38/102 |
| 4,378,646 | 4/1983 | Mazeika | 38/102 |
| 4,501,080 | 2/1985 | Rich | 38/102.7 |

FOREIGN PATENT DOCUMENTS

| | | |
|---|---|---|
| 0009920 | of 1895 | United Kingdom . |
| 0003434 | of 1904 | United Kingdom . |

*Primary Examiner*—Werner H. Schroeder
*Assistant Examiner*—Ismael Izaguirre
*Attorney, Agent, or Firm*—Walter C. Farley

[57] ABSTRACT

An adjustable base for supporting a selected one of a plurality of needlework frames of different sizes includes an H-shaped structure and slider plates which are receivable in the end recesses of the H-shaped structure, each slider plate carrying a support arm which is attachable to an end of the needlework frame. When changing from one frame to a different frame of a different size, the slider plates are easily adjusted in or out to vary the distance between the support arms to accommodate the new frame.

4 Claims, 2 Drawing Sheets

ADJUSTABLE BASE FOR NEEDLEWORK FRAME

This invention relates to an adjustable base which can be adjusted to receive a selected one of a plurality of needlework-holding frames.

BACKGROUND OF THE INVENTION

It is well known to provide a frame for supporting a sheet of cloth fabric which is to be the background or base medium for needlework. The general objective is to provide a frame which holds the fabric in a flat position such that both sides of the fabric are available, permitting the needle to be alternately inserted from opposite sides.

One such frame is shown in co-pending U.S. Design patent application Ser. No. 161,619, filed Feb. 29, 1988, in the name of the present applicant. This frame is particularly advantageous in that it provides generally parallel side members and cylindrical top and bottom members, forming a rectangular frame, with pieces of fabric permanently attached to the top and bottom members to which the needlework fabric can be temporarily stitched. The top and bottom members can be loosened and rotated to roll part of the needlework fabric onto one or both of these members, permitting the needlework fabric to be scrolled from the top to the bottom, for example, as the work progresses.

The structure shown in the above-identified application can be made so that the frame is in any one of a number of sizes. Normally, the end members are about the same size, but the top and bottom members can be made in various lengths to accommodate needlework projects of various sizes. It has been customary to supply a needlework frame with a needlework base which is dimensioned to support the frame so that the upstanding arms of the base, to which the frame is attached, are spaced apart the proper distance to receive the frame. Thus, one might purchase a 13 in. frame and a 13 in. base, a 22 in. frame and a 22 in. base, etc.

While these matching frame and base structures work very well, the need to purchase a new base with each new frame of a different size involves additional expense for the purchaser and also requires additional storage for the bases which are not being used. Many users choose to have more than one project in progress at any given time, sometimes on frames of different sizes, and it becomes necessary to either transport or store each entire frame and base structure rather than just the frame itself.

SUMMARY OF THE INVENTION

Accordingly, an object of the present invention is to provide a base which is adjustable so as to vary the spacing between the upstanding arms which support a needlework frame, thereby rendering the base adaptable to frames of various sizes within the range which the base can accommodate.

Briefly described, the invention comprises an adjustable base for supporting any selected one of a plurality of needlework frames of generally rectangular configuration, the frames having means thereon for holding a piece of fabric, the frames having various lengths within a predetermined range, the base comprising means defining a generally H-shaped structure with U-shaped recesses at both ends thereof separated by a central portion, each recess having parallel edges facing each other. First and second end members each include a slider plate having parallel opposite edges, a support arm attachable to one end of one of the frames and means for holding the support arm on the slider plate, each slider plate being dimensioned fit between the parallel edges. Guide means are provided on the parallel edges for receiving the slider plates, the slider plates being independently movable toward and away from the central portion to vary the spacing between the support arms, thereby to select proper spacing between the support arms to receive a selected one of the frames.

BRIEF DESCRIPTION OF THE DRAWINGS

In order to impart full understanding of the manner in which the foregoing and other objects are attained in accordance with the invention, a particularly advantageous embodiment thereof will be described with reference to the accompanying drawings, which form a part of this specification, and wherein.

DESCRIPTION OF THE PREFERRED EMBODIMENT

Figure 1:
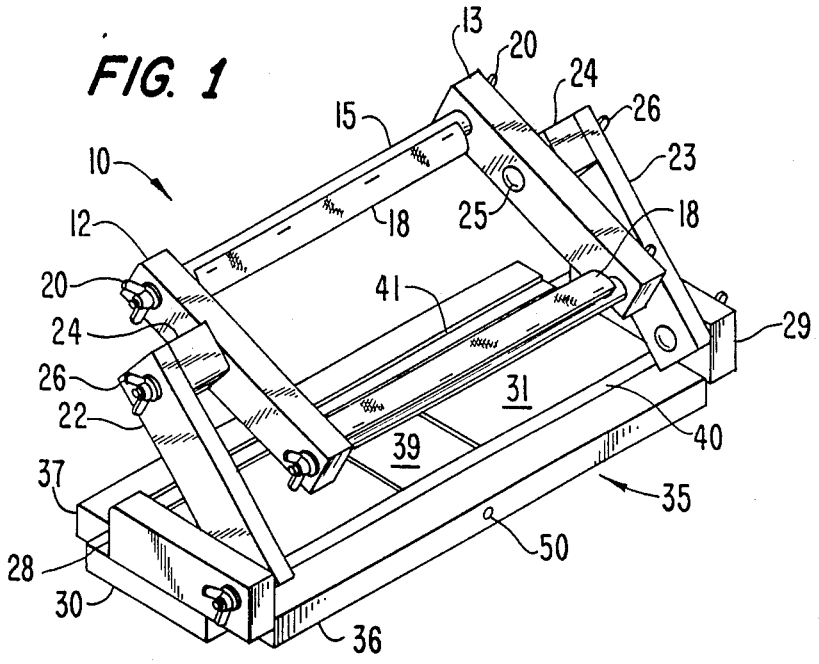
FIG. 1 is a perspective view of a frame and base in accordance with the invention, the frame being of a relatively short length.

FIG. 1 shows an assembled frame and base, the needlework having been omitted therefrom for clarity. The frame, indicated generally at 10, includes parallel side members 12 and 13 which are interconnected by upper and lowwer members 15 and 16, respectively. Members 15 and 16 are provided with long, narrow pieces of coarse cloth 18 to which the upper and lower edges of the needlework fabric can be basted to hold the cloth between the upper and lower members. Normally, the needlework fabric will be longer or taller than the distance between members 15 and 16, in which case a portion of the fabric can be rolled onto one or both of those members. Members 15 and 16 are provided with threaded bolts protruding from the ends thereof which pass through holes in members 12 and 13 and are secured by wing nuts 20.

The frame is held on support arms 22 and 23 by carriage bolts 25 and wing nuts 26, the bolts passing through spacer blocks 24 and the upper ends of the support arms, the lower ends thereof being attached to support blocks 28 and 29, again by carriage bolts and wing nuts. Support blocks 28 and 29 are fixedly attached to slider plates 30 and 31 which form part of the base structure along with blocks 28, 29 and support arms 22, 23.

A generally H-shaped structure indicated generally at 35 includes front and rear elongated base members 36 and 37 and a central member 39 which extends between members 36 and 37 and is fixedly attached thereto. Central member 39 holds members 36 and 37 in a generally parallel relationship and extends between those members at a location intermediate the ends thereof to form the H-shaped frame structure. Member 39 is dimensioned so that slider plates 30 and 31 can fit between the inwardly facing parallel edges of members 36 and 37. As will be further described in connection with the other figures, track members 40 and 41 are attached to members 36 and 37 and are arranged to slidingly engage plates 30 and 31 so that those plates can be slidably moved relative to the H-shaped structure.

As seen in FIG. 1, the frame 10 is the shortest frame which can be accommodated by frame structure 35, that is, the length, as measured between the outer surfaces of members 12 and 13, is substantially equal to the distance between the inner surfaces of blocks 24 on support arms 22 and 23 with slider plates 30 and 31 positioned so that their inner ends are adjacent central portion 39.

Figure 2:
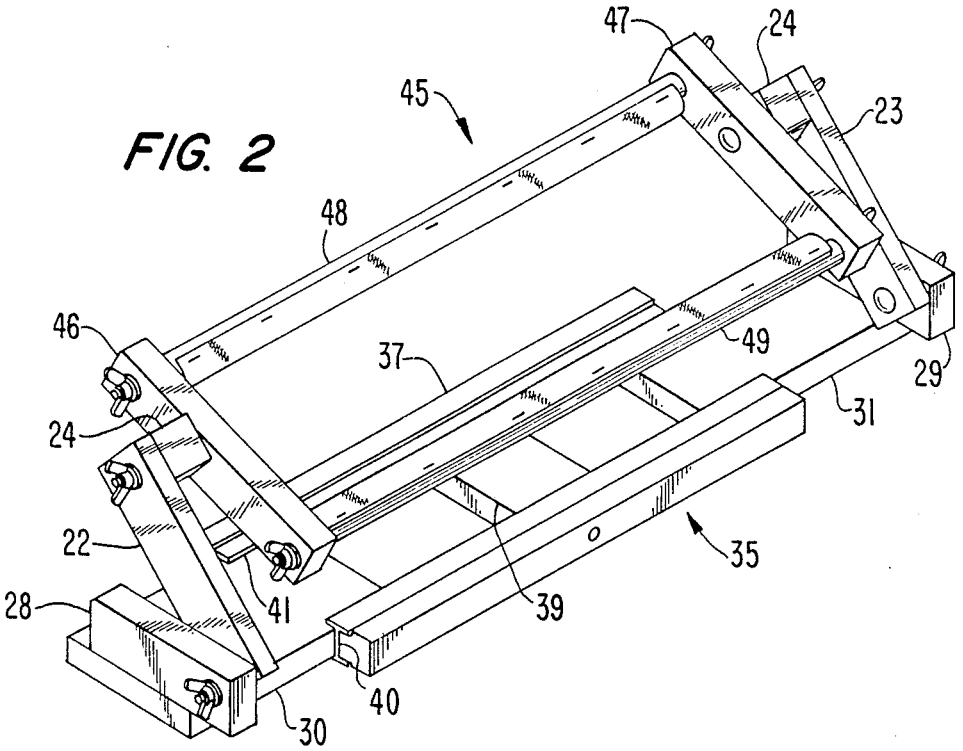
FIG. 2 is a perspective view of a frame and base in accordance with the invention, the frame being longer than that of FIG. 1 and the base being expanded to receive the frame.

A similar structure is shown in FIG. 2 in which the same base accommodates a frame indicated generally at 45 which is considerably longer than frame 10. The basic structure of frame 45 is the same as frame 10, having end members 46 and 47, upper and lower members 48 and 49 and the interconnecting hardware. However, as will be apparent, upper and lower members 48 and 49 are much longer than the equivalent members in frame 10 and, thus, the distance between the outer surfaces of members 46 and 47 is considerably greater then the equivalent distance of members 12 and 13. Accordingly, the inner surfaces of blocks 24 on support arms 22 and 23 must be further apart in order to accommodate this frame.

This is accomplished by sliding the slider plates 30 and 31 outwardly away from central portion 39, leaving a space between the inner ends of the slider blocks and the central portion. As will be apparent, there is a limit beyond which the slider plates cannot be extracted without losing engagement with the tracks 40 and 41 attached to members 36 and 37. This limit defines the greatest length of frame which can be accommodated by this base structure. Between that outer limit and the inner limit illustrated in FIG. 1 there is a range of frame sizes which can be accommodated and which, in a practical embodiment of the structure, permits the base to accommodate at least four practical sizes of frames ranging from 13 to 22 in.

Figure 3:
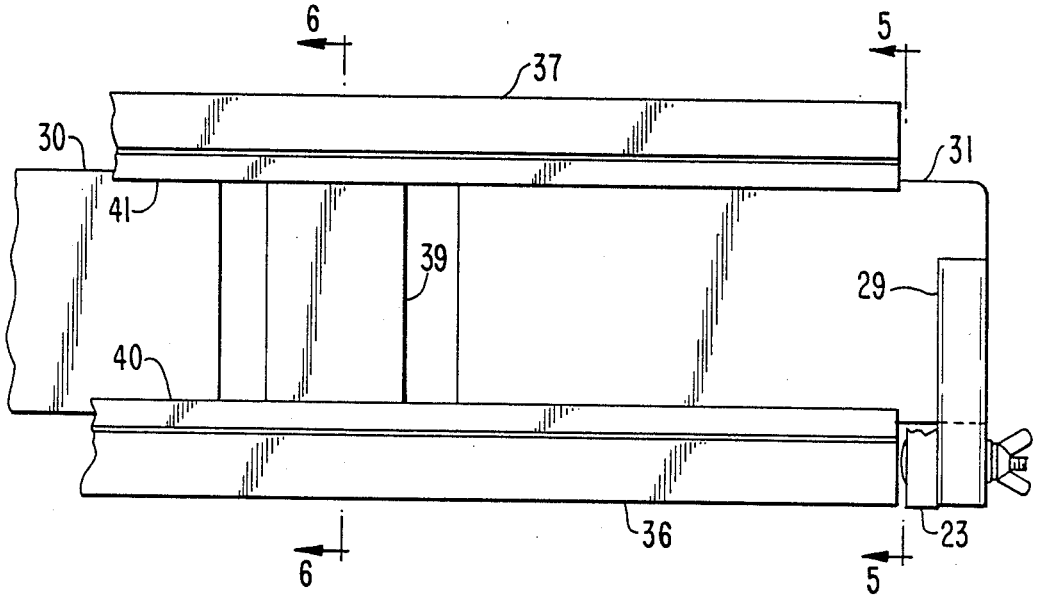
FIG. 3 is a partial top plan view of a base in accordance with the invention with the frame removed.
Figure 4:
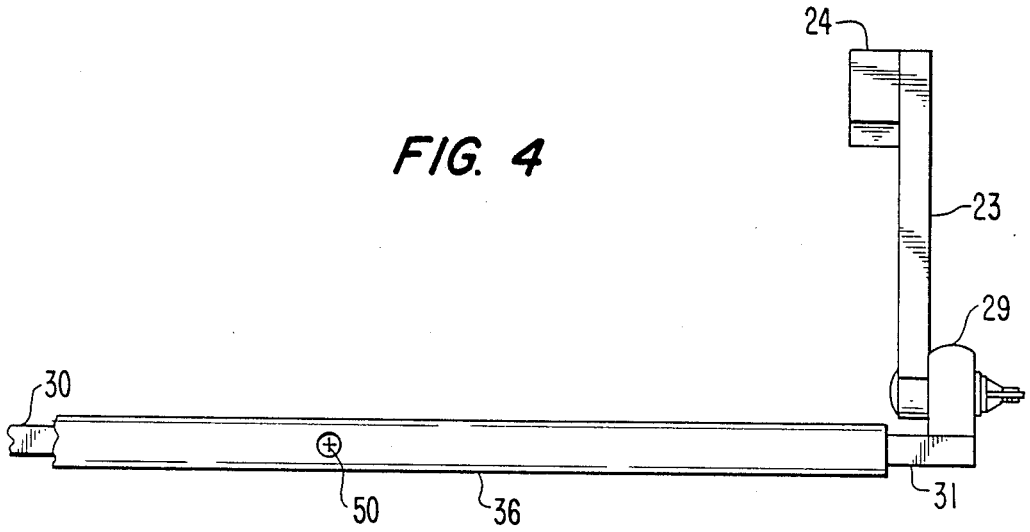
FIG. 4 is a partial front elevation of the base of FIG. 3.
Figure 5:
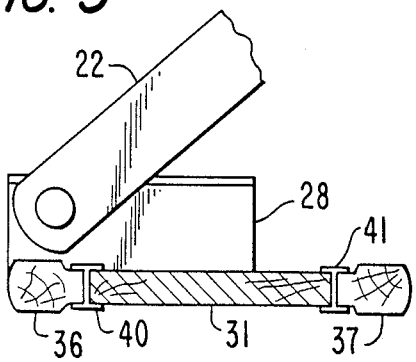
FIG. 5 is a side elevation, in section, along line 5—5 of FIG. 3.
Figure 6:
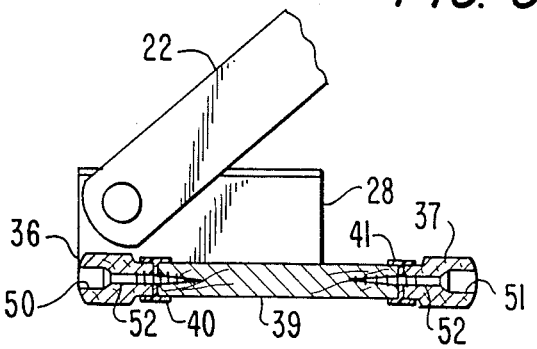
FIG. 6 is a side elevation, in section, along line 6—6 of FIG. 3.

FIGS. 3 and 4 show a substantial portion of the base structure with the frame removed and with support arm 23 cut away (in FIG. 3) to avoid obscuring any portion of the base structure below it. As will be seen from these figures, slider plates 30 and 31 are slidably received by tracks 40 and 41 so that they are movable toward and away from central member 39. Front and rear elongated members 36 and 37 are rigidly interconnected to member 39 by screws which pass through openings 50 and 51 which are substantially centrally located in members 36 and 37, the screws being shown in the sectional view of FIG. 6. As seen in FIG. 2 and, more clearly, in FIGS. 5 and 6, each of the track members 40 and 41 is generally I-shaped in cross section with the height of the track being about 9/16 in. and the width of the top and bottom flange portions each being about 7/16 in. The tracks are made by extrusion using a polymeric material such as acrylonitrile butadiene styrene (ABS), resulting in a track which has stiff, self-supporting characteristics. One side of each track member is fixedly attached to its associated front or rear member 36 or 37 by the central member 39 and screw 52 which passes through the track member and into central portion 39. The other side of each track member engages central portion 39 and, on either side of that central portion, one of the slider plates.

The remainder of the members of the frame and base are preferably made of wood although plastic and other materials can be employed, if desired. The hardware is, of course, conventional in nature and includes items such as carriage bolts, lag screws, wing nuts and washers.

While one advantageous embodiment has been chosen for illustration, it will be recognized by those skilled in the art that various modifications can be made therein without departing from the scope of the invention as defined in the appended claims.

What is claimed is:

1. An adjustment base for supporting any frame selected from a group of needlework frames of generally rectangular configuration, the frames having means thereon for holding a piece of fabric, the frames of the group having several different lengths within a predetermined range of lengths, the base comprising means defining a generally H-shaped structure with generally U-shaped recesses at both ends thereof separated by a central portion, each said recess having parallel edges facing each other;

first and second end members, each said end member including a slider plate having parallel opposite edges, a support arm attachable to one end of one of said frames and means for holding said support arm on said slider plate, each said slider plate being dimensioned to fit between said parallel edges; and guide means on said parallel edges for receiving said slider plates, said slider plates being independently movable toward and away from said central portion to vary the spacing between said support arms, thereby to select a proper spacing to receive a selected one of said frames.

2. A base according to claim 1 wherein said guide means comprises a track having upper and lower generally parallel flanges extending along each of said parallel edges, said flanges being spaced apart to receive an edge of a slider plate therebetween in sliding relationship.

3. An adjustable base for supporting a selected one of a plurality of needlework frames of generally rectangular configuration, each frame having means thereon for holding a piece of fabric, the frames having various lengths within a predetermined range, the base comprising first and second elongated member;

a cross member rigidly connected to said first and second members at intermediate locations between the ends thereof to form a generally H-shaped base structure with said first and second elongated members in spaced relationship and having parallel, inwardly facing edges facing each other on both sides of said crossmember;

first and second end members, each said end member including a slider plate having parallel opposite edges, a support arm attachable to one end of one of said frames and means for holding said support arm on said slider plate, each said slider plate being dimensioned to fit between said inwardly facing edges; and means defining tracks on said inwardly facing edges for receiving said slider plates, said slider plates being independently movable toward and away from said crossmember to vary the spacing between said support arms and thereby to select a proper spacing to receive one of said frames.

4. A base according to claim 3 wherein said means defining tracks comprises upper and lower generally parallel flanges extending away from each of said parallel edges, said flanges being spaced apart to receive an edge of a slider plate therebetween in sliding relationship.

* * * * *